US008201634B2

(12) United States Patent
Laurel et al.

(10) Patent No.: US 8,201,634 B2
(45) Date of Patent: Jun. 19, 2012

(54) SUBSEA CEMENTING PLUG SYSTEM WITH PLUG LAUNCHING TOOL

(75) Inventors: David Fernando Laurel, Cypress, TX (US); Kurt Randall Koenig, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 398 days.

(21) Appl. No.: 12/469,370

(22) Filed: May 20, 2009

(65) Prior Publication Data

US 2010/0294503 A1 Nov. 25, 2010

(51) Int. Cl.
*E21B 33/13* (2006.01)
*E21B 33/16* (2006.01)

(52) U.S. Cl. ..... 166/335; 166/153; 166/156

(58) Field of Classification Search ..... 166/335, 166/153, 156, 177.3, 177.4
See application file for complete search history.

(56) References Cited

U.S. PATENT DOCUMENTS 4,671,358 A 6/1987 Lindsey, Jr. et al.
5,722,491 A * 3/1998 Sullaway et al. ..... 166/291
2008/0251253 A1 10/2008 Lumbye

FOREIGN PATENT DOCUMENTS

EP 1619350 A1 1/2006

OTHER PUBLICATIONS

International Search Report and Written Opinion from PCT Application No. PCT/US2010/027926 dated Sep. 30, 2010.

* cited by examiner

*Primary Examiner* — Thomas Beach
*Assistant Examiner* — James Sayre
(74) *Attorney, Agent, or Firm* — Parsons Behle & Latimer

(57) ABSTRACT

A subsea cementing system that includes a first wiper plug having a central bore releasably connected to a launching mandrel, and a second wiper plug having a central bore releasably connected to the first wiper plug. The system includes a first dart that is adapted to seal the central bore of the second wiper plug. A first increase in pressure releases the second wiper plug from the first wiper plug and a second increase in pressure breaks a burst disc of the first dart allowing cement to flow past the second wiper plug. A second wiper dart is adapted to seal the central bore of the first wiper plug. A third increase in pressure releases the first wiper plug from the launching mandrel. A fourth increase in pressure releases a sealing member from the second dart, which is adapted to seal the central bore of the second wiper plug.

30 Claims, 7 Drawing Sheets

SUBSEA CEMENTING PLUG SYSTEM WITH PLUG LAUNCHING TOOL

BACKGROUND OF THE INVENTION

1. Field of the Invention

The present disclosure relates generally to an improved cementing plug system with a subsea plug launching tool for offshore oil and gas wells. More particularly, the present disclosure is directed to an improved subsea cementing plug system well suited for cementing subsea casing strings in deep water.

2. Description of the Related Art

Offshore drilling activity continues to move into deeper water with depths of up to 10,000 feet now being experienced. Subsea launch cementing plug technology was developed to address the shallow water depths of 500 feet or less. Operational challenges such as non-observance of plug launch pressures, free fall rate of weighted ball, and inability to wipe drill pipe inside diameter prior to cementing have been experienced moving into deeper waters. Due to operations in deeper water, it can take a long time for an operator to get a pressure indication that the ball has release the bottom cement plug potentially causing the operator to start pumping displacement fluid and cement prematurely. In this instance there is no pressure indication when the bottom plug has launched because the ball is being pumped down.

Prior cementing systems have utilized shear pins to selectively secure the cement plugs to the launching tool. However, the use of shear pins potentially permits the cement plugs to be launched by any differential pressure which exerts a force across the shear pins potentially inadvertent launching of the cement plug. The use of shear pins also potentially permits the wrong plug to be launched due to a pressure differential. It would be beneficial to provide a system that prevents inadvertent launching of a cement plug.

In light of the foregoing, it would be desirable to provide a subsea cement plug system that uses a top plug and a bottom plug that seals at the bottom of the bottom plug after the cement has been displaced into the casing annulus and the top plug has been bumped. It would also be desirable to provide a subsea cement system that connects the top plug to a bottom plug with a collet to prevent the premature separation of the plugs. It would further be desirable to provide a subsea cement system that used full bore cement plugs that allow a device, such as a ball, to be dropped through the plugs that may be used to actuate a tool located below the cement plugs, such as an auto fill float collar.

The present disclosure is directed to overcoming, or at least reducing the effects of, one or more of the issues set forth above.

SUMMARY OF THE INVENTION

One embodiment the present disclosure provides a subsea cementing system that includes a launching mandrel positioned within a casing string. A running string (e.g., a drill pipe string) extends from a rig floor of a drilling vessel to the launching mandrel. A top cement plug having at least one wiper and a central bore is releasably connected to the launching mandrel. A bottom cement plug having at least one wiper and a central bore is releasably connected to the top cement plug. The wipers of the cement plugs may be a foamed elastomer to permit the use of the cement plugs on various size of casing strings. The system includes a lower dart that has a central bore through the dart and one or more wiper fins. A rupture member closes the central bore of the dart in its initial state. The rupture member may be any device that may be selectively ruptured such as a rupture disc or membrane as would be appreciated by one of ordinary skill in the art having the benefit of this disclosure. The rupture member may be made of a frangible material such as ceramic, glass, thermoset plastic, cloth, or even metal. The lower dart provides a fluid barrier between the fluid in the running string (e.g., drilling mud) and the fluid used to displace the dart (e.g., a spacer fluid or cement slurry). The lower dart is also adapted to engage and seal the central bore of the bottom cement plug. The dart is launched from a surface launch apparatus, is displaced down the running string and mates in the bottom cement plug. Afterwards, a first increase in pressure within the running string releases the bottom cement plug from the top cement plug. The bottom plug travels down the casing string and engages a profile in a landing device in the casing string. The profile may be adapted to prevent rotation of the bottom plug with respect to the landing device. An increase in pressure within the casing string is used to break the rupture member of the lower dart. Once the rupture member is ruptured, cement may be pumped past the bottom plug, through the landing device, and into the annulus between the casing and borehole. The landing device may be a float collar, float shoe, landing collar, or equivalent structure as would be recognized by one of ordinary skill in the art.

After all of the cement has been mixed and pumped, an upper dart may then be launched from the surface launch apparatus into the system. Like the lower dart, the upper dart includes one or more fins sized to wipe the inside diameter of the running string. The upper dart acts as a fluid barrier between the cement slurry and the displacing fluid (e.g., drilling mud, spacer or a brine). The upper dart also includes a central bore and an inner sealing member selectively retained within the central bore. The upper dart is adapted to engage and seal the central bore of the upper cement plug. After engaging the top cement plug, a preselected increase in pressure within the running string releases the top cement plug and upper dart from the launching mandrel. The top plug with the upper dart travels down the casing string and engages a profile in the bottom plug. The profile may be adapted to prevent the rotation of the top plug with respect to the bottom plug. An increase in pressure within the casing string releases the inner sealing member from the central bore of the upper dart. The inner sealing member is adapted to seal the central bore of the bottom cement plug or the bore of the landing device.

As discussed above, the top cement plug and bottom cement plug are releasably connected in the running position. A collet is preferably used to releasably connect the plugs. The first increase in pressure applied to the lower dart moves a shiftable sleeve releasing the collet from one of the plugs. Likewise, a collet may be used to connect the top cement plug to the subsea launching mandrel. A subsequent increase in pressure applied to the upper dart shifts a shearably connected release sleeve to release the collet connecting the top plug to the subsea launching mandrel.

One embodiment is directed to a method of cementing a subsea casing string that includes positioning a launching mandrel into the casing string, wherein a top plug with a central bore and at least one wiper is releasably connected to the launching mandrel. A bottom plug with a central bore and at least one wiper is releasably connected to the top plug. The method includes launching a first dart into a running string that extends from a rig floor to the subsea launching mandrel. The first dart is adapted to sealingly engage the central bore of the bottom plug. The method further includes pumping cement into the running string, landing the lower dart in the bottom plug, and increasing the pressure within the running string to a first selected pressure, wherein the bottom plug is released from the top plug. The combined lower dart and bottom plug forming a movable fluid barrier in the casing string between the cement behind the plug and the wellbore fluid ahead of the plug.

The preferred method further includes landing the bottom plug within a profile in a landing device in the casing string and increasing the pressure within the casing string to a second selected pressure, wherein the second selected pressure breaks a rupture member within a central bore of the first dart allowing cement to flow past the landed bottom plug and into the annulus about the casing. A second dart may then be launched into the running string and a second fluid is then pumped into the running string behind the dart to displace the dart and cement slurry to the top plug. The second dart is adapted to sealingly engage the central bore of the top plug.

An increase in pressure within the running string releases the top plug from the launching mandrel. The upper dart and top plug collectively forming a movable fluid barrier for displacing the cement in the casing string. The preferred method includes landing the top plug within a profile in the bottom plug and increasing the pressure within the casing string to a selected pressure to launch an inner sealing member from the upper dart. The inner sealing member is adapted to seal the central bore of the bottom plug or the landing device.

In a preferred embodiment, the first selected pressure applied to the running string may cause the first dart to move a sleeve within the bottom plug releasing a collet holding the bottom plug to the top plug. The second selected pressure applied to the running string may rupture the rupture member within a central bore of the first dart. The third selected pressure applied to the running string may cause the second dart to move a sleeve within the top plug releasing a collet holding the top plug to the launch mandrel. The fourth selected pressure applied to the casing string may shear a shearable device on the upper dart to release the inner sealing member.

Another embodiment is directed to a system for cementing a subsea casing string that includes a first wiper plug having a central bore, the first wiper plug being releasably connected to a launching mandrel and a second wiper plug having a central bore, the second wiper plug being releasably connected below the first wiper plug. The central bores of the wipers permit a device, such as a ball, to be dropped through the wiper plugs to actuate a tool located below both wiper plugs.

The system further comprises a first dart having a rupture member, wherein the first dart is adapted to seal the central bore of the lower wiper plug. After the first dart lands in the lower plug, an increase in pressure within the running string releases the lower wiper plug from the upper wiper plug and a subsequent increase in pressure in the casing string breaks the rupture member of the first dart allowing fluid to flow past the lower wiper plug. A second dart is adapted to seal the central bore of the upper wiper plug. An increase in pressure within the running string, applied after the second dart lands in the upper plug, releases the upper wiper plug from the launching mandrel. The system includes a sealing element releasably connected to the second dart, the sealing element being adapted to seal the central bore of the lower wiper plug or the landing device. The sealing element is released from the second dart upon a preselected increase in pressure within the casing string and seals the central bore of the lower wiper plug.

Figure 1:
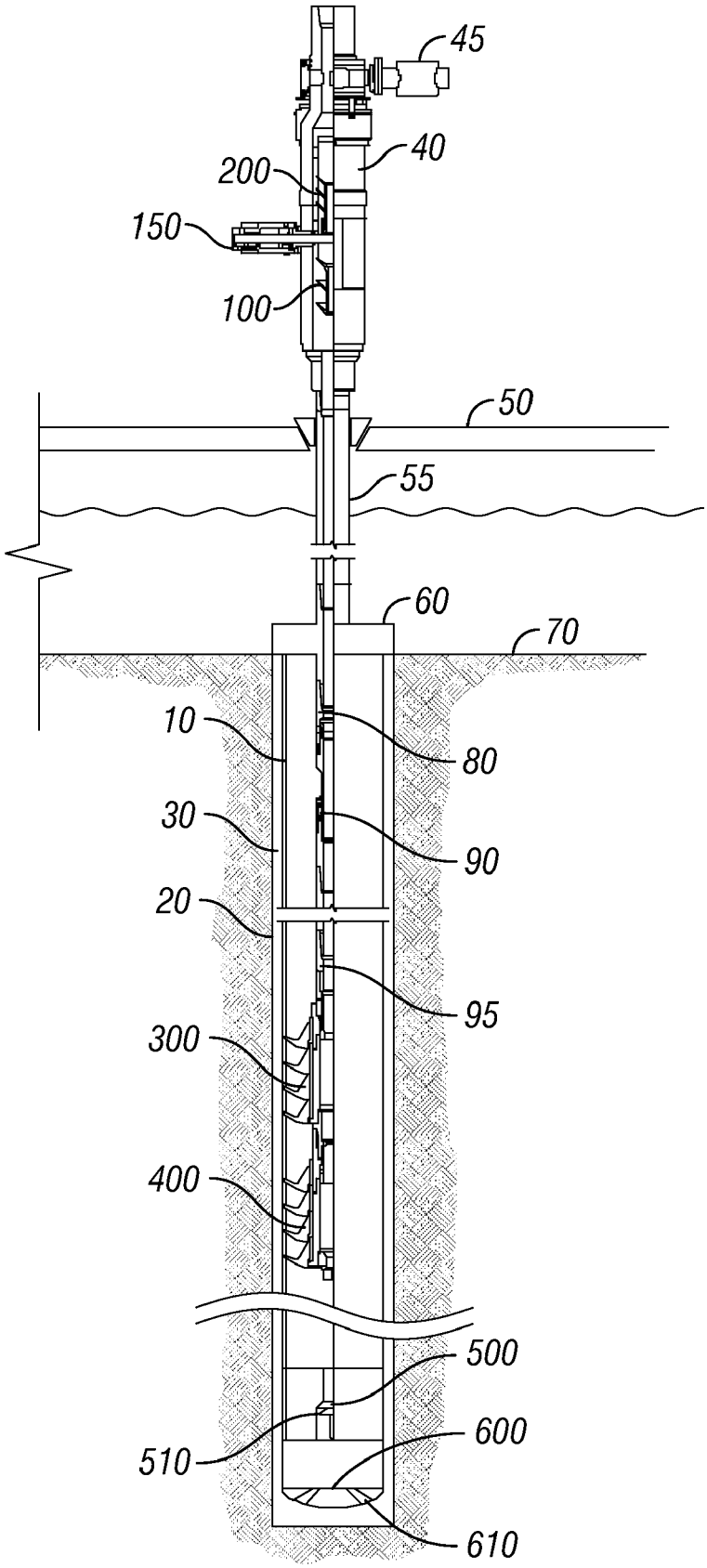
FIG. 1 shows a partial cross-sectional view of the layout for one embodiment of a subsea cement system.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the disclosure are described below as they might be employed in a subsea cement system. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the disclosure will become apparent from consideration of the following description and drawings.

FIG. 1 shows a partial cross-sectional view of one embodiment of a subsea cementing system. This system includes a cementing head 40, such as the top drive cementing head shown in FIG. 1 suspended from the mast of an offshore drilling vessel (not shown). The cementing head 40 houses top dart 200 and bottom dart 100. Holding mechanism 150 allows for the selected release of darts 100 and 200. The cementing head may be adapted to connect to the top drive of the drilling vessel. Drilling fluids and/or completion fluids may be provided to the system through the cementing head. Connection 45 provides the vessel's cementing unit access to the top drive head.

Running string 55 extends from the lower end of the top drive head. The running string, typically comprised of drill pipe, extends from the rig floor 50 to the casing hanger 60 adjacent the seafloor 70. As shown in FIG. 1, casing string 10 extends from hanger 60 into the wellbore. The distal end of casing string 10 includes a landing device that comprises a float collar 500 and float shoe 600. Float collar 500 includes a one way check valve 510 which allows fluid flow down through the casing string and out fluid passageways 610 of float shoe 600 but prevents fluid flow from flowing back into the casing string from the annulus 30 between casing string 10 and borehole 20. Although not shown, float shoe 600 may also include a one way check valve. In an alternative embodiment, only a float shoe with a one way check valve is used in the casing string and the cement plugs land on top of the shoe. In this embodiment, the float shoe may include a profile for receiving an extension on the bottom plug for preventing rotation between the plug and the shoe upon subsequent drillout. Landing devices such as float collars, float shoes, and landing collars are well known in the art.

A portion of running string 55 extends past casing hanger 60 into casing string 10. The running string may include an annulus release valve 80 and swivel 90, which may be used to relieve accumulated pressure built up in the annulus above the top plug during run in and circulation prior to cementing operations. The lower end of running string 55 is connected to launching mandrel 95. Releasably connected to launching mandrel 95 is top plug 300. Releasably connected to top plug 300 is bottom plug 400. As explained in more detail below, both top plug 300 and bottom plug 400 have central bores that are in fluid communication with running string 55.

Figure 2:
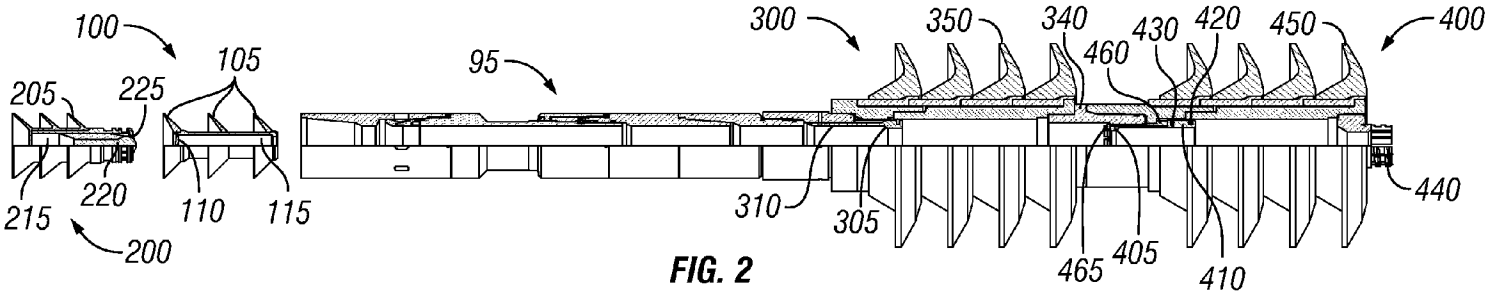
FIG. 2 shows a partial cross-sectional view of the components of one embodiment of a subsea cement system prior to launching the first dart.

FIG. 2 illustrates a partial cross sectional view of the components of one embodiment of a subsea cementing system prior to launching the first dart. Upper dart 200 includes central bore 215 and one or more elastomer wiper fins 205. The wiper fins are flexible by nature. Wiper fins 205 are sized to wipe the inner diameter of running string 55, thereby providing a moveable fluid barrier for the running string. Upper dart 200 includes an inner sealing member 220 that is releasably mounted in central bore 215. The nose of upper dart 200 includes retaining ring 225.

Lower dart 100 includes central bore 115 and a rupture member 110, herein after referred to as a rupture disc. Lower dart 100 includes one or more elastomer wiper fins 105 that are sized to wipe the inner diameter of running string 55. Like the upper dart 200, lower dart 100 provides a moveable fluid barrier for the running string 55.

Figure 7:
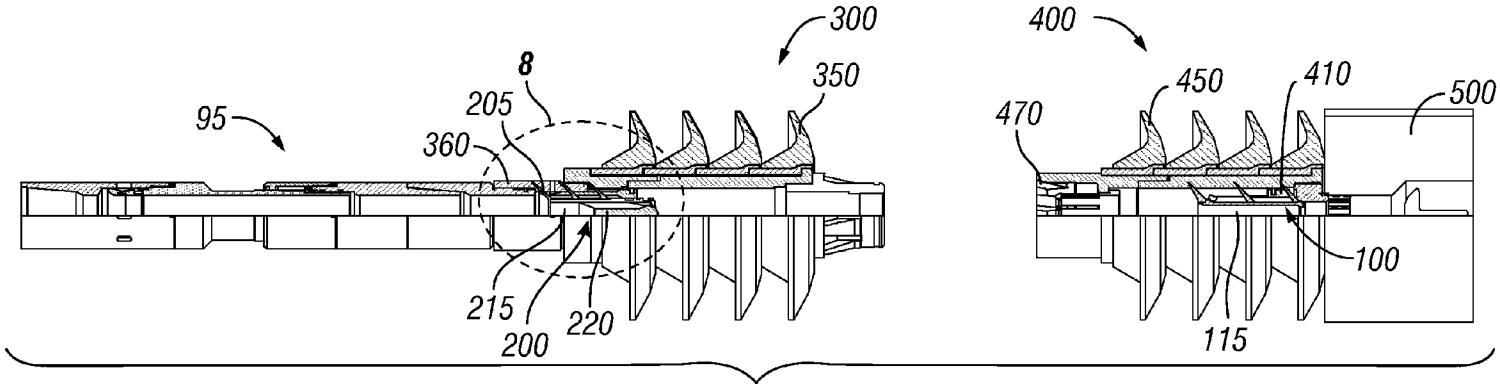
FIG. 7 shows a partial cross-sectional view of the second dart sealing the central bore of the top plug prior to the release of the top plug from the launching mandrel.
Figure 8:
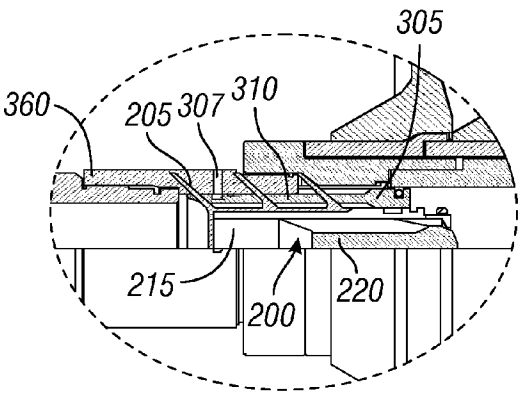
FIG. 8 shows a close-up view of the second dart shifting a release sleeve to release the top plug from the launching mandrel.

Top plug 300 is releasably attached to launching mandrel 95 via collet 360 shown in FIGS. 7 and 8. Top plug 300 includes one or more wiper fins 350 for wiping the inner diameter of casing 10. Top plug 300 includes inner sleeve 310, which is slidably mounted to the inner diameter of the plug and which supports the plurality of collet fingers extending from collet 360. The lower end of sleeve 310 includes shoulder 305, the shoulder having an external recess for an annular seal to seal the space between the sleeve and the internal bore of top plug 300. Spline 340 extends from the lower end of the top plug. Spline 340 includes internal shoulder 365 as shown in FIG. 5.

Figure 3:
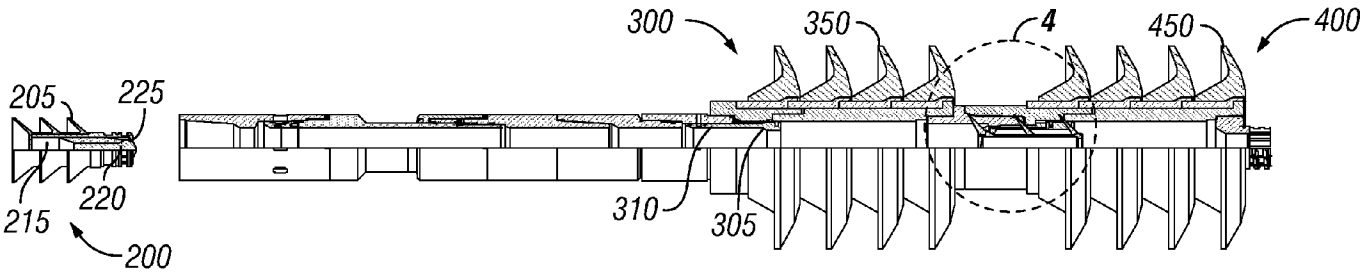
FIG. 3 shows a partial cross-sectional view of the first dart sealing the central bore of the bottom plug of the subsea cement system prior to the release of the bottom plug from the top plug.
Figure 4:
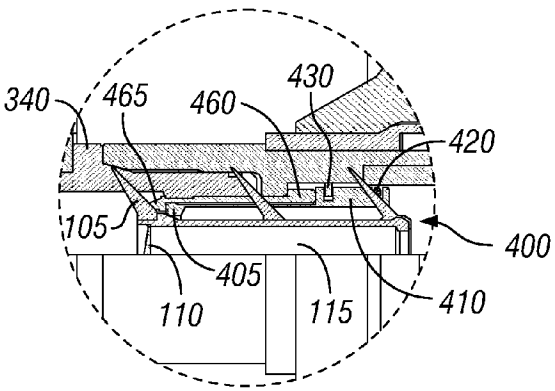
FIG. 4 shows a close-up view of the first dart shifting a release sleeve to release the bottom plug from the top plug.

Bottom plug 400 includes one or more wiper fins 450, which like fins 350, are sized to wipe of the inner diameter of the casing string 10. The distal end of plug 400 includes anti-rotation device 440. Bottom plug 400 is releasably connected to shoulder 365 (shown in FIG. 5) of top plug 300 via collet 460. Collet 460 includes a plurality of collet fingers which terminate at shoulder 465. Collet 460 is supported by internal sleeve 410 which is slidably mounted in the internal bore of plug 400. The upper end of sleeve 410 includes shoulder 405 which, as shown in FIGS. 2-4, abuts shoulders 465 on the fingers of collet 460. Sleeve 410 also includes latch ring 430 and annular seal 420. Seal 420 seals the annular space between sleeve 410 and the internal bore of bottom plug 400.

Once casing 10 has been run into the wellbore to the desired location, it is common practice to circulate and condition the drilling mud in borehole 20. Once the drilling mud has been properly conditioned, cement mixing is commenced. The cement slurry is pumped to top drive head 40 through connection 45. Lower dart 100 is dropped and displaced down the running string ahead of the cement slurry. A spacer fluid may be displaced ahead of the cement to act as a buffer between the cement and drilling mud. Lower dart 100 acts as a fluid barrier in the running string 55 between the cement slurry and the drilling mud or spacer ahead of the dart 100. The lower dart 100 is displaced down the running string 55 and into launching mandrel 95 until it is landed on releasing sleeve 410 as shown in FIGS. 3 and 4. FIGS. 3 and 4 show the lower dart 100 sealing the central bore of bottom plug 400 prior to the release of the bottom plug from the upper plug. Once the lower dart lands in release sleeve 410, the pressure inside the running string is increased until the differential pressure acting across the lower dart causes the sleeve 410 to slide downward relative to collet 460. Once releasing sleeve 410 slides downwardly, the collet fingers of collet 460 are no longer supported and thus can deflect radially inwardly, thereby releasing shoulder 465 from shoulder 365 (shown in FIG. 5) of top plug 300. Once this occurs, the bottom plug 400 is released and the combined lower dart and bottom plug are displaced down the casing string. The combined lower dart 100 and bottom plug 400 combine to provide a moveable fluid barrier for the casing string 10.

Figure 5:
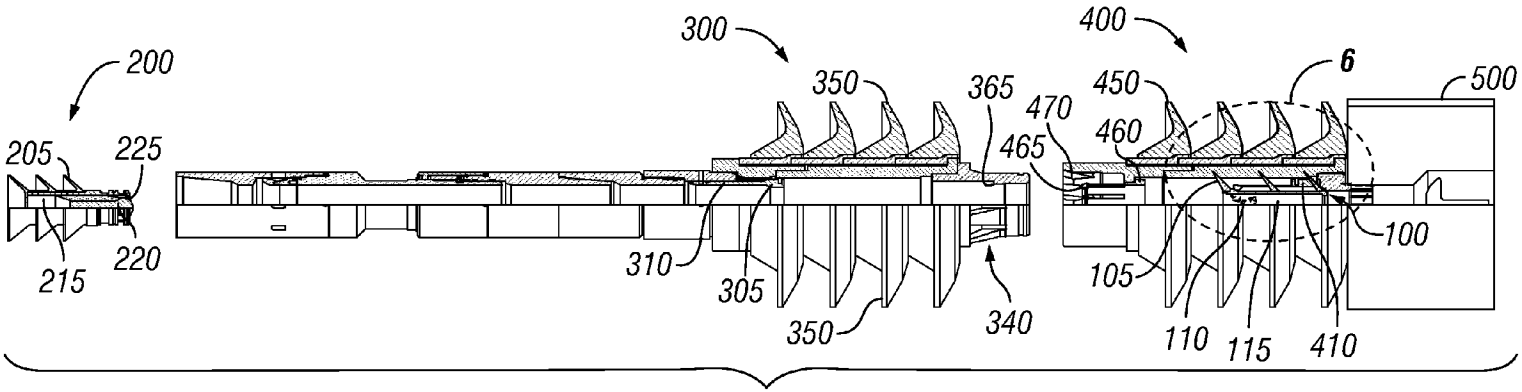
FIG. 5 shows a partial cross sectional view of the bottom plug landed in the float collar.
Figure 6:
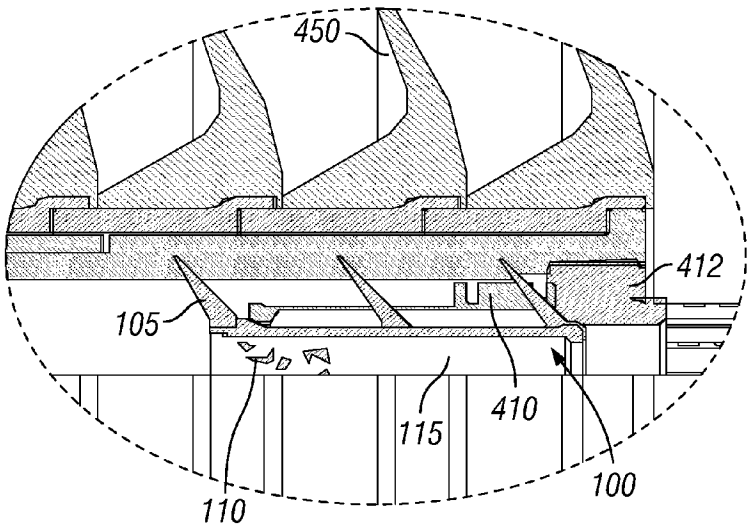
FIG. 6 shows a close-up view of a broken burst disc in the first dart allowing cement to flow past the bottom plug.

FIG. 5 illustrates the bottom plug 400 released from the top plug 300 and landed on float collar 500. The lower dart 100 and sleeve 410 have landed on the bottom seat 412 of the bottom plug 400 as shown in FIGS. 5 and 6. In a preferred embodiment, anti-rotation device 440 (shown in FIG. 3) lands in a mating profile in float collar 500 to prevent relative rotation between bottom plug 400 and the float collar 500 during drillout. Once the bottom plug 400 has landed on the float collar 500, a pre-selected increase in pressure inside the casing string 10 will rupture the frangible rupture disc 110 thereby providing fluid passage for the cement slurry through bore 115 of the lower dart 100. FIGS. 5 and 6 illustrate the frangible rupture disc 110 as being ruptured. The cement slurry will continue through the bottom plug 400, through float collar 500, through float shoe 600 and out into annulus 30.

After the desired volume of cement has been mixed and pumped to the top drive head, holding mechanism 150 is actuated to drop the top dart 200 into the running string 55. The top dart 200 is displaced through the running string 55 by a displacing fluid which may be a spacer, drilling mud, brine or other fluid or combination thereof. The top dart 200 acts as a moveable fluid barrier inside the running string 55. Top dart 200 is displaced down the running string 55 until it lands on the top plug releasing sleeve 310 as shown in FIGS. 7 and 8. The top dart 200 will land on internal shoulder 305 of release sleeve 310. The pressure inside the workstring 55 will be increased until the differential pressure across the top dart 200 shears one or more shearing devices which holds release sleeve 310 in place. By way of example, the shearing device may be one or more shear pins 307 extending through collet 360. When release sleeve 310 is shifted downwardly relative to collet 360, supporting shoulder 305 moves past the end of the collet fingers 362 (shown in FIG. 9) extending from collet 360. The collet fingers 362 may then radially collapse thereby releasing the top plug 300 from the launching mandrel 95.

Figure 9:
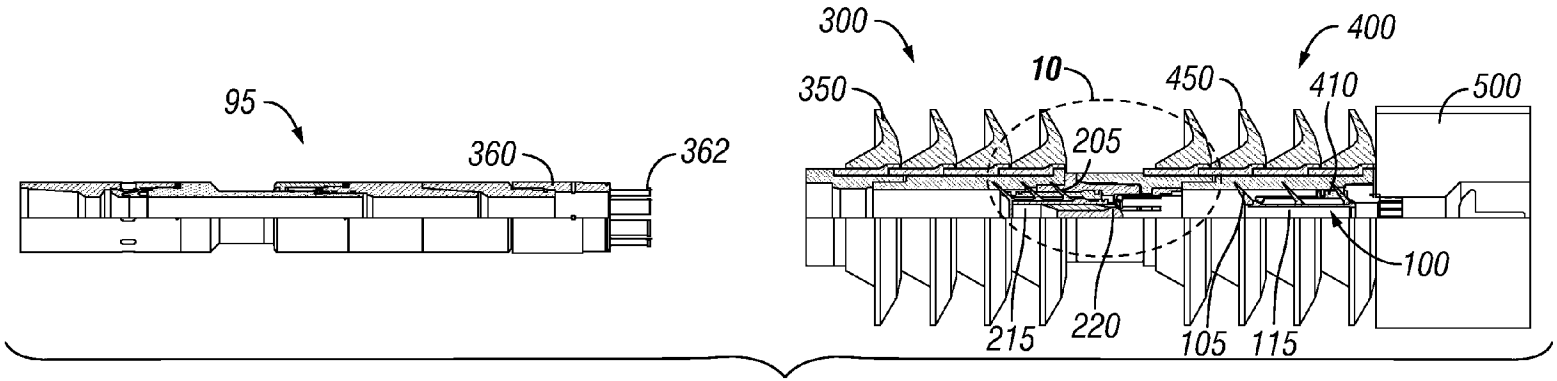
FIG. 9 shows a partial cross-sectional view of the top plug landed in the bottom plug in the casing string.
Figure 10:
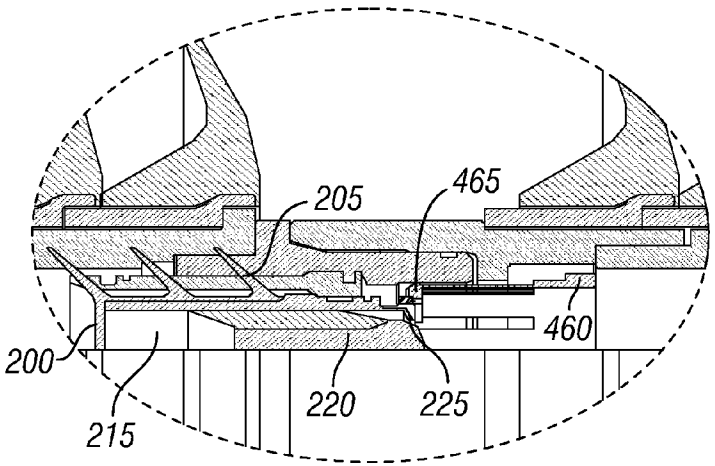
FIG. 10 shows a close-up view of the second dart being forced against the collet of the bottom plug.

Top plug 300 and upper dart 200 are displaced together down the casing string 10 displacing the trailing end of the cement slurry down the casing 10. The top plug 300 and upper dart 200 combine to provide a moveable fluid barrier for the casing 10. As shown in FIG. 9, the top plug 300 lands in bottom plug 400, with the nose of the upper dart 200 landing on the shoulder 465 of bottom plug collet 460 as shown in FIGS. 9 and 10. An increase in pressure will be evident at the surface which will provide an indication that the top plug 300 has reached the bottom plug 400/float collar 500 (i.e., the top plug 300 has been bumped). FIG. 10 shows the upper dart 200 forced against the shoulder 465 of collet 460. FIG. 10 also illustrates the inner sealing member 220 and retaining ring 225.

Figure 11:
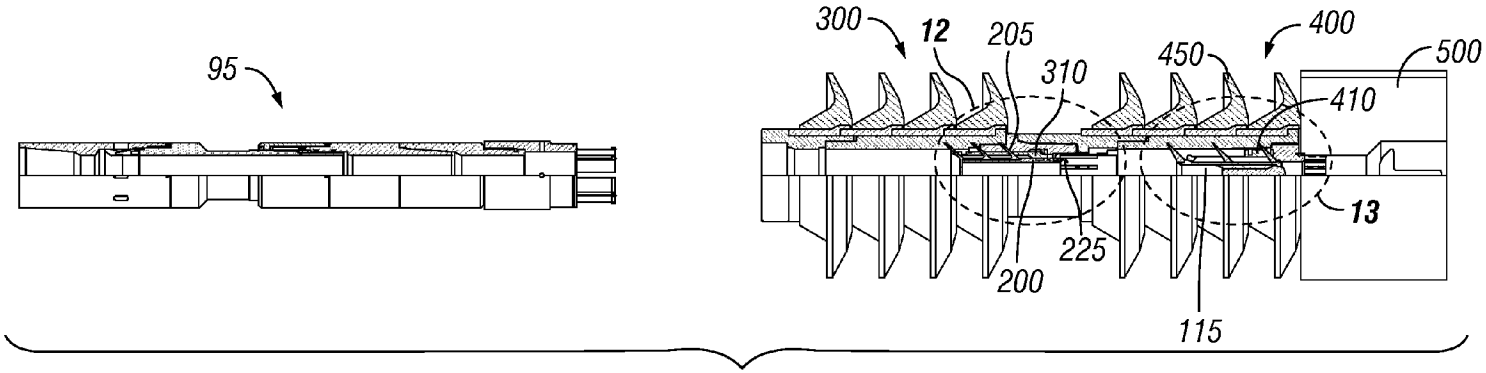
FIG. 11 shows a partial cross-sectional view of the central bore of the bottom plug sealed by an inner sealing member released from the second dart.
Figure 13:
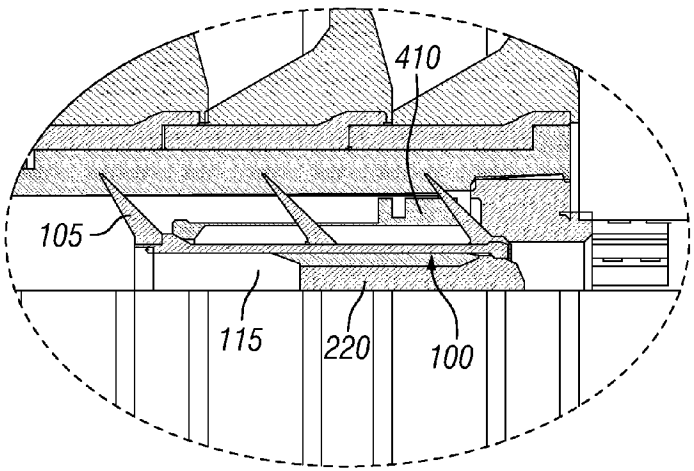
FIG. 13 shows a close-up view of the inner sealing member sealing the central bore of the bottom plug.
Figure 12:
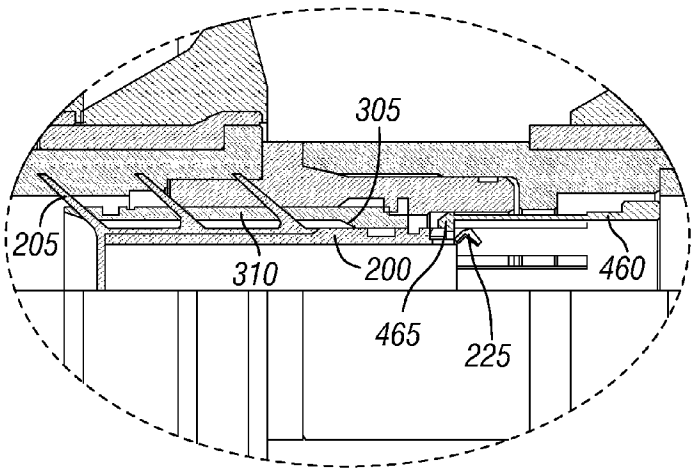
FIG. 12 shows a close-up view of the second dart after the retaining ring has been sheared by the collet of the bottom plug.

The pressure inside the casing string 10 is increased until the pressure across the inner sealing member 220 shears the retaining ring 225 allowing sealing member 220 to be displaced out of the upper dart 200 and down to the bottom plug 400, as illustrated in FIGS. 11-13. FIG. 12 illustrates retaining ring 225 after it has been sheared. Sealing member 220 lands on the lower dart inner seat as shown in FIGS. 11 and 13. The landing of the inner sealing member 220 and bottom plug 400 provides an improved seal and enhanced collapse resistance over prior art subsea cementing plugs. The inner sealing member 220 provides a seal as near as possible to the float collar or on the float collar at the end of the cementing operations, which may provide much higher casing pressure capabilities. The location of the inner sealing member 220 helps to prevent subjecting the cement plugs and components to differential pressure, which could induce hoop stresses and compression loads. Prior sealing members located at the top of the top plug may collapse or become crushed when subjected to the high pressures in deepwater cementing operations. When top plug 300 lands on bottom plug 400, spine 340 (shown in FIG. 5) engages the upper anti-rotation profile 470 (shown in FIG. 5) on bottom plug 400. The engagement of spine 340 with anti-rotation profile 470 prevents rotation of top plug 300 relative to bottom plug 400 during subsequent drillout of the plugs and float equipment.

Figure 14:
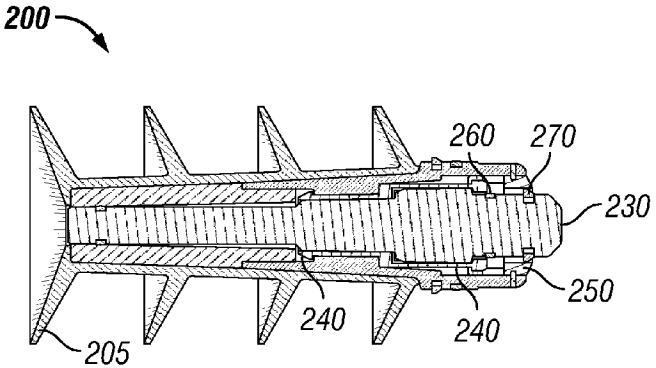
FIG. 14 shows a cross-sectional view of one embodiment of a top dart that includes an inner seal mandrel.

FIG. 14 illustrates a cross-sectional view of one embodiment of an upper dart 200 that may be used in a subsea cementing system. The upper dart 200 includes central bore 215 (shown in FIG. 16) and one or more elastomer wiper fins 205. The wiper fins are flexible by nature. Wiper fins 205 are sized to wipe the inner diameter of running string 55, thereby providing a moveable fluid barrier for the running string. The upper dart 200 includes an inner sealing mandrel 230 that is releasably mounted in central bore 215 of the upper dart 200. The inner sealing mandrel 230 includes a sealing element 260 that provides a seal when the sealing mandrel 230 engages the central bore 115 of the lower dart 100, as discussed in more detail below. The inner sealing mandrel 230 may include a locking mechanism 270 to retain the inner sealing mandrel 230 in position after it has engaged the central bore 115 of the lower dart 100. The location, number, and configuration of the sealing element 260 and locking means is for illustrative purposes only and may be varied within the spirit of the disclosure as would be appreciated by one of ordinary skill in the art having the benefit of this disclosure. A collet 240 is used to selectively retain the inner sealing mandrel 230 within the central bore 215 of the upper dart. A release sleeve 250 may be moved to cause the collet 240 to release the inner sealing mandrel 230 upon engagement with the lower dart 100.

Figure 15:
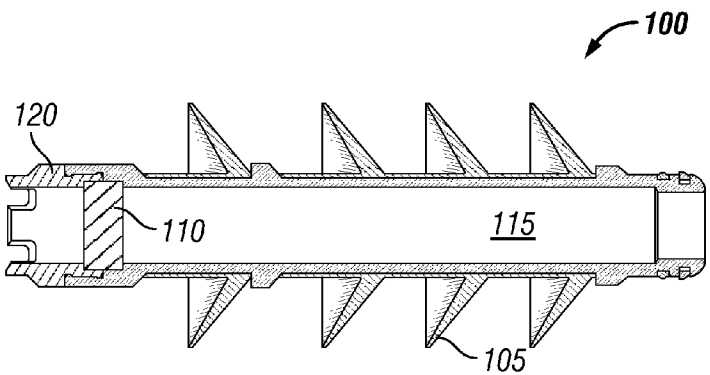
FIG. 15 shows a cross-sectional view of one embodiment of a bottom dart with an upper portion configured to release the inner seal mandrel from the top dart of FIG. 14.

FIG. 15 illustrates a cross-sectional view of one embodiment of a lower dart 100 that may be used in connection with the upper dart 200 of FIG. 14. The lower dart 100 includes central bore 115 and a rupture member 110. The lower dart 100 also includes one or more elastomer wiper fins 105 that are sized to wipe the inner diameter of running string 55. Like the upper dart 200, lower dart 100 provides a moveable fluid barrier for the running string 55. The lower dart 100 includes an upper portion 120 that is configured to actuate the release sleeve 250 when the upper dart 200 engages the lower dart 100. The actuation of the release sleeve 250 provides for the release of the inner sealing mandrel 230 from the collet 240 of the upper dart 200.

Figure 16:
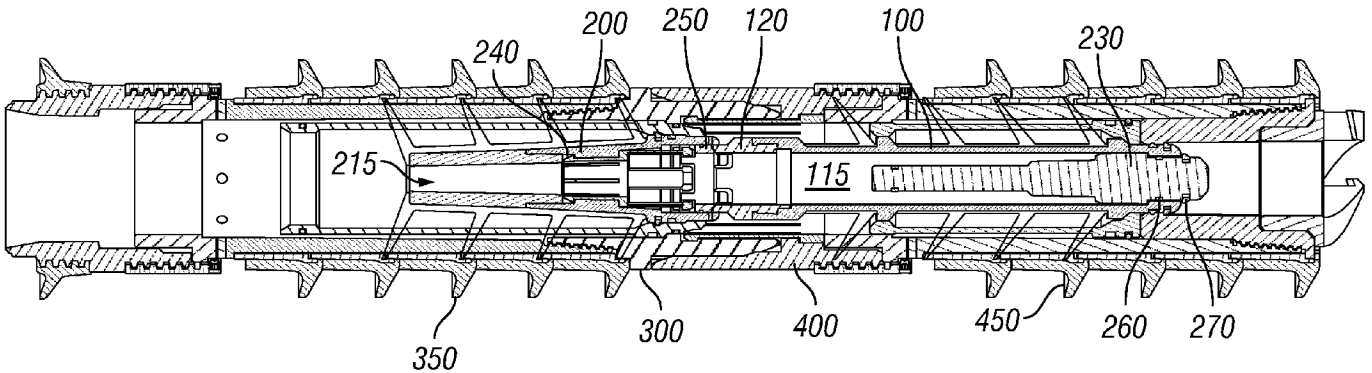
FIG. 16 shows a cross-section view of a top plug landed in a bottom plug with the top dart and bottom dart of FIGS. 14 and 15.

FIG. 16 shows a cross-sectional view of the inner sealing mandrel 230 landed within the central bore 115 of the lower dart 100. The top plug 300 has landed on the bottom plug 400, as discussed above, engaging the upper portion 120 of the lower dart 100 with the upper dart 200 causing the actuation of the release sleeve 250 and releasing the inner sealing mandrel 230 from the collet 240. The locking mechanism 270 of the inner sealing mandrel 230 engages a portion of the lower dart 100, which may prevent unwanted uphole movement of the inner sealing mechanism 230 due to an under balanced well condition. The locking mechanism 270 could be a spring loaded lock dog or various locking mechanisms as would be appreciated by one of ordinary skill in the art. The sealing element 260 engages a portion of the lower dart 100 in the central bore 115 providing a seal that prevents flow through the top and bottom plugs 300 and 400. The sealing element 260 of the inner sealing mandrel 230 provides a seal as near as possible to the float collar or on the float collar at the end of the cementing operations, which may provide much higher casing pressure capabilities. The location of the sealing member 260 helps to prevent subjecting the cement plugs and components to differential pressure, which could induce hoop stresses and compression loads. Prior sealing members located at the top of the top plug may collapse or become crushed when subjected to the high pressures in deepwater cementing operations.

Although various embodiments have been shown and described, the invention is not so limited and will be understood to include all such modifications and variations as would be apparent to one skilled in the art.

What is claimed is:

1. A subsea cementing system, the system comprising:

a launching mandrel positioned within a casing string;

a top plug having at least one wiper and a central bore, the top plug being releasably connected to the launching mandrel;

a bottom plug having at least one wiper and a central bore, the bottom plug being releasably connected to the top plug;

a lower dart including a central bore that is selectively closed by a rupture member, wherein the lower dart is adapted to engage and seal the central bore of the bottom plug, wherein a first increase in pressure releases the bottom plug and dart from the top plug, the bottom plug and lower dart collectively forming a moveable fluid barrier in the casing string, wherein the bottom plug is adapted to land on a landing device in the casing string and a second increase in pressure breaks the rupture disc;

an upper dart including a central bore and an inner sealing member selectively retained within the central bore of the upper dart, wherein the upper dart is adapted to engage and seal the central bore of the top plug, wherein a third increase in pressure releases the top plug and upper dart from the launching mandrel, the top plug and upper dart collectively forming a moveable fluid barrier in the casing string, wherein the top plug is adapted to land on the bottom plug and a fourth increase in pressure releases the inner sealing member from the central bore of the upper dart; and wherein the released inner sealing member is adapted to seal the central bore of the bottom plug.

2. The system of claim 1 wherein a lower collet releasably connects bottom plug to the top plug.

3. The system of claim 2 wherein the first increase in pressure shifts a moveable sleeve thereby the collet releases the bottom plug.

4. The system of claim 1 wherein an upper collet releasably connects the top plug to the launching mandrel.

5. The system of claim 4 wherein the third increase in pressure shears a shearable device holding a moveable sleeve, and further shifts the sleeve thereby the collet releases the upper plug.

6. The system of claim 1 wherein a profile on the landing device mates with a first profile on the bottom plug to prevent rotation of the bottom plug with respect to the landing device.

7. The system of claim 1 wherein a second profile on the bottom plug mates with a profile on the top plug to prevent rotation of the top plug with respect to the bottom plug.

8. The system of claim 1 wherein the rupture member comprises ceramic, glass, thermoset plastic, cloth, or frangible metal.

9. The system of claim 1 wherein the at least one wiper of the bottom plug is a foamed elastomer.

10. A method of cementing a subsea casing string, the method comprising:

positioning a launching mandrel into the casing string, a top plug having a central bore and at least one wiper, the top plug being releasably connected to the launching mandrel, and a bottom plug having a central bore and at least one wiper, the bottom plug being releasably connected to the top plug;

launching a first dart and displacing the dart to the launching mandrel, wherein the first dart is adapted to sealingly engage the central bore of the bottom plug;

increasing the pressure to a first selected pressure, wherein the bottom plug is released from the top plug;

displacing the combined bottom plug and first dart down the casing string;

landing the bottom plug and first dart on a landing device in the casing string;

increasing the pressure within the casing string to a second selected pressure, wherein a rupture member within a central bore of the first dart breaks allowing cement to flow through the bottom plug;

launching a second dart and displacing the second dart to the launching mandrel, wherein the second dart is adapted to sealingly engage the central bore of the top plug;

increasing the pressure to a third selected pressure, wherein the top plug is released from the launching mandrel;

displacing the combined top plug and second dart down the casing string;

landing the top plug on the bottom plug;

increasing the pressure within the casing string to a fourth selected pressure to release an inner sealing member from the second dart, the inner sealing member landing in and sealing the central bore of the bottom plug.

11. The method of claim 10 further comprising providing a profile in the landing device, the profile adapted to mate with a first profile on the bottom plug thereby preventing rotation of the bottom plug with respect to the landing device.

12. The method of claim 10 further comprising providing a second profile of the lower plug to mate with a profile on the top plug thereby preventing rotation of the top plug with respect to the bottom plug.

13. The method of claim 10 further comprising releasably connecting the bottom plug to the top plug with a lower collet.

14. The method of claim 13 wherein the first selected pressure on the first dart moves a sleeve permitting the lower collet to release the bottom plug from the top plug.

15. The method of claim 10 wherein an upper collet connects the top plug to the launch mandrel.

16. The method of claim 15 wherein the third selected pressure on the second dart moves a sleeve permitting the upper collet to release the top plug from the launch mandrel.

17. The method of claim 10 wherein the fourth selected pressure shears a shearable device on the second dart to release the inner sealing member.

18. A system for cementing a subsea casing string, the system comprising:

a first wiper plug having a central bore being releasably connected to a launching mandrel;

a second wiper plug having a central bore, the second wiper plug being releasably connected to the first wiper plug, wherein the central bores of the wiper plugs permit a device to be dropped through the wiper plugs to actuate a tool located below both the wiper plugs;

a first dart having a rupture member, the first dart being adapted to seal the central bore of the second wiper plug, wherein an increase in pressure after the first dart lands in and seals the central bore of the second wiper plug releases the second wiper plug from the first wiper plug and a subsequent increase in pressure in the casing string breaks the rupture member of the first dart allowing fluid to flow through the second wiper plug;

a second dart adapted to seal the central bore of the first wiper plug, wherein an increase in pressure after the second dart lands in and seals the central bore of the first wiper plug releases the first wiper plug from the launching mandrel; and a sealing element releasably connected to the second dart, wherein the sealing element is selectively released from the second dart to seal the central bore of the second wiper plug.

19. The system of claim 18 wherein a collet connects the first plug to the second plug.

20. The system of claim 19 wherein the first dart moves a sleeve allowing the collet to release the second plug from the first plug.

21. The system of claim 18 wherein a collet connects the first plug to the launching mandrel.

22. The system of claim 21 wherein the second dart moves a sleeve allowing the collet to release the first plug from the launching mandrel.

23. The system of claim 1 wherein the landing device is a float collar, float shoe, or landing collar.

24. The system of claim 18 wherein the sealing element is selectively released upon a preselected increase in pressure within the casing string.

25. The system of claim 18 wherein a collet selectively connects the sealing element to the second dart.

26. The system of claim 25 further comprising a movable release sleeve connected to the second dart, wherein engagement of the second dart with the first dart actuates the release sleeve to release the sealing element from the collet.

27. The system of claim 18 wherein the sealing element comprises a mandrel having at least one sealing element and a locking mechanism.

28. A dart system for the launching of subsea cement plugs to cement a subsea casing string, the dart system comprising:

a lower dart having an axial bore, at least one elastomer wiper, and a rupture member selectively closing axial bore, the lower dart being adapted to seal a central bore of a wiper plug;

an upper dart having an axial bore, at least one elastomer wiper, and a seal mandrel, the seal mandrel having at least one sealing element, the seal mandrel being selectively retained in the axial bore, and the upper dart being adapted to engage an upper portion of the lower dart;

wherein the upper portion of the lower dart is adapted to release the seal mandrel from the upper dart when engaged by the upper dart; and wherein the released seal mandrel provides a seal within the axial bore of the lower dart or within a bore of a landing device.

29. The dart system of claim 28 wherein the upper dart further comprises a collet that selectively retains the seal mandrel within the axial bore of the upper dart.

30. The dart system of claim 29 wherein the upper dart further comprises a movable release sleeve that engages the collet to release the seal mandrel from the axial bore of the upper dart.

* * * * *